United States Patent [19]

Gastebois et al.

[11] Patent Number: 4,802,824

[45] Date of Patent: Feb. 7, 1989

[54] TURBINE ROTOR

[75] Inventors: Philippe M. D. Gastebois, Vert Saint Denis; Jean-Francois R. Imbault, Ponthierry, both of France

[73] Assignee: Societe Nationale d'Etude et Moteurs d'Aviation "S.N.E.C.M.A.", Paris, France

[21] Appl. No.: 131,725

[22] Filed: Dec. 11, 1987

[30] Foreign Application Priority Data

Dec. 17, 1986 [FR] France ..... 86 17634

[51] Int. Cl.[4] ..... F01D 5/32

[52] U.S. Cl. ..... 416/193 A; 416/241 B

[58] Field of Search ..... 416/193 A, 241 B

[56] References Cited

U.S. PATENT DOCUMENTS

| | | | |
|---|---|---|---|
| 2,317,338 | 4/1943 | Rydmark | 416/221 |
| 2,950,083 | 8/1960 | Compton et al. . | |
| 3,008,689 | 11/1961 | Morley et al. | 416/193 A X |
| 3,132,841 | 5/1964 | Wilder . | |
| 3,294,364 | 12/1966 | Stanley | 416/193 A |
| 3,606,572 | 9/1971 | Schwedland | 416/193 A X |
| 3,679,324 | 7/1972 | Stargardter | 416/229 |
| 3,810,711 | 5/1974 | Emmerson et al. | 416/193 A X |
| 4,050,850 | 9/1977 | Beckershoff | 416/193 A X |
| 4,277,225 | 7/1981 | DuBois et al. | 416/193 A X |
| 4,343,593 | 8/1982 | Harris | 416/193 A |
| 4,417,854 | 11/1983 | Cain et al. | 416/241 B |
| 4,501,053 | 2/1985 | Craig et al. | 416/193 A X |
| 4,563,125 | 1/1986 | Boudigues et al. | 416/241 B X |

FOREIGN PATENT DOCUMENTS

| | | | |
|---|---|---|---|
| 204382 | 7/1956 | Australia | 416/193 A |
| 216406 | 5/1958 | Australia | 416/193 A |
| 550328 | 4/1932 | Fed. Rep. of Germany . | |
| 830854 | 1/1952 | Fed. Rep. of Germany . | |
| 2307967 | 9/1973 | Fed. Rep. of Germany | 416/193 A |
| 1016683 | 11/1952 | France | 416/193 A |
| 1281033 | 11/1961 | France | 416/241 B |
| 2073854 | 1/1971 | France . | |
| 2154050 | 4/1973 | France . | |
| 2164134 | 7/1973 | France . | |
| 2176350 | 10/1973 | France . | |
| 2538029 | 6/1984 | France . | |
| 653267 | 5/1951 | United Kingdom | 416/193 A |

*Primary Examiner*—Everette A. Powell, Jr.
*Attorney, Agent, or Firm*—Oblon, Fisher, Spivak, McClelland & Maier

[57] ABSTRACT

A turbine rotor has composite ceramic blades each having a bulb-shaped root with planar flanks which define an angle of convergence between them not exceeding ten degrees, and by which the root is held in a dovetail section socket in the periphery of the rotor disc by means of wedge-shaped members also disposed in the socket on opposite sides of the root. Each wedge-shaped member is part of an element including a platform which is disposed adjacent the curved portion of the blade radially outwards of the socket and which is joined to the wedge-shaped member by an integral strut. The platforms of all of the elements extend in a circumferential direction and combine to define a continuous ring forming part of the inner boundary of the gas flow path through the turbine.

5 Claims, 2 Drawing Sheets

TURBINE ROTOR

BACKGROUND OF THE INVENTION

1. Field of the Invention

The present invention relates to a turbine rotor having blades of composite ceramic material.

The search to improve performance in modern turbine plant, particularly in the aeronautical field, has led to a constant rise of working temperatures, particularly the temperatures at the turbine inlet. These operating conditions have brought about technical design developments, covering in particular arrangements concerned with cooling in order to obtain an acceptable service life of the mechanical parts forming the turbine, particularly those parts most exposed to the flow of hot gases, such as the turbine rotor blades. A parallel stream of developments has also taken place in the perfecting of new materials having improved resistance to high temperatures while meeting the demands of the mechanical or aerodynamic operation. Along these lines attempts have been made at using various composite materials, particularly those based on ceramic fibres. Several examples illustrate these known techniques.

2. Summary of the Prior Art

French Pat. No. 2176350 relates to a composite blade and describes a particular method of tibre distribution and of their arrangement for the transition from the aerofoil portion of the blade to its root, which may be, for example, of dovetailed shape.

French Pat. No. 2154050 relates to a method of constructing a turbine blade of which the aerofoil portion of the blade is composed of fibre reinforced layers, and the root has hardened wedges inserted between the layers.

French Pat. No. 2538029 describes ceramic blades having a metal core surrounded by a covering of refractory ceramic, and including air flow and inner cooling arrangements associated therewith. A flared root of the blade is rigidly secured to the central core by a securing pin.

West German Pat. No. 830854 describes a ceramic blade of which the bulb of the root has an angle of convergence between the sides limited to a value deduced from the characteristics of the material, particularly from the ratio of the admissible compressive and tensile stresses.

However, none of the known arrangements is completely satisfactory. Indeed, either the presence of metal parts in the blade causes the loss of the chief advantages to be obtained from the use of composite materials, or very complex fibre arrangements are demanded which cause manufacturing difficulties in the arrangement of the fibres or fabrics, both in the transition from the aerofoil portion of the blade to its root and in the shaping of the root, or also in the transition from the aerofoil portion to the platform of the blade.

The object of the present invention, therefore, is to provide a turbine rotor having blades of the above-mentioned type which avoids the drawbacks associated with the previously known solutions.

SUMMARY OF THE INVENTION

According to the invention, there is provided a turbine rotor comprising a disc, a plurality of rectilinear, axially oriented sockets in the periphery of said disc, said sockets being evenly distributed around said periphery and each having side walls and a bottom wall providing said socket with a dovetail shaped cross-section, a plurality of blades disposed in said sockets and projecting radially outwards from said periphery of said disc, said blades being formed of a composite ceramic fibre material and each of said blades having an aerofoil shaped body radially outwards of said disc defining concavely and convexly curved sides of said blade, and a root received in one of said sockets, said root being in the form of a bulb and having a bottom face and two flat side faces defining an angle of convergence towards said body not exceeding 10° whereby said ceramic fibres of said blade proceed continuously from said body to said root of said blade without geometric distortion, and locking means associated with each of said blades for locking said blade in said corresponding socket, said locking means including a pair of elements disposed on opposite sides of said blade, each of said elements comprising a wedge-shaped member disposed in said socket between one of said side faces of said root and the adjacent one of said side walls of said socket to ensure radial locking of said blade, a platform disposed adjacent said blade radially outwards of said disc and extending in a circumferential direction, and a strut connecting said platform to said wedge-shaped member, said platforms of said elements of said locking means of all of said blades co-operating to form a continuous ring intersected by said blades and defining part of the inner boundary of the main streamline flow path of the turbine gases.

In a particular embodiment of the invention the platforms of the two elements situated between each pair of successive blades may be joined together whereby said two elements are joined to thus form a unitary bridge-shaped part extending between said pair of blades and having a wedge-shaped member and strut at each end, and a continuous platform between said struts.

A turbine rotor in accordance with the invention has substantial advantages. It permits using a composite ceramic material, which provides advantageous results of resistance and operating performance at high working temperatures, as well as resistance to corrosion, and mechanical and mass characteristics suitable for the construction of blades with cambered profiles. As a result of the dissociation of the blade from the platform, they each lend themselves to production from composite ceramic materials, and a junction between the curved portion and the root of the blade can be achieved using continuous fibres not subject to shape distortions harmful to satisfactory operating performance as a result of separation between the aerodynamic functions of the blade and the functions of connection, and radial holding or locking of the blades. These functions are performed by associated members which are separate from the blade root, namely the wedge-shaped members of the platform elements.

Other characteristics and advantages of the invention will become apparent from the following description of embodiments of the invention with reference to the attached drawings.

DESCRIPTION OF THE PREFERRED EMBODIMENTS

Figure 1:
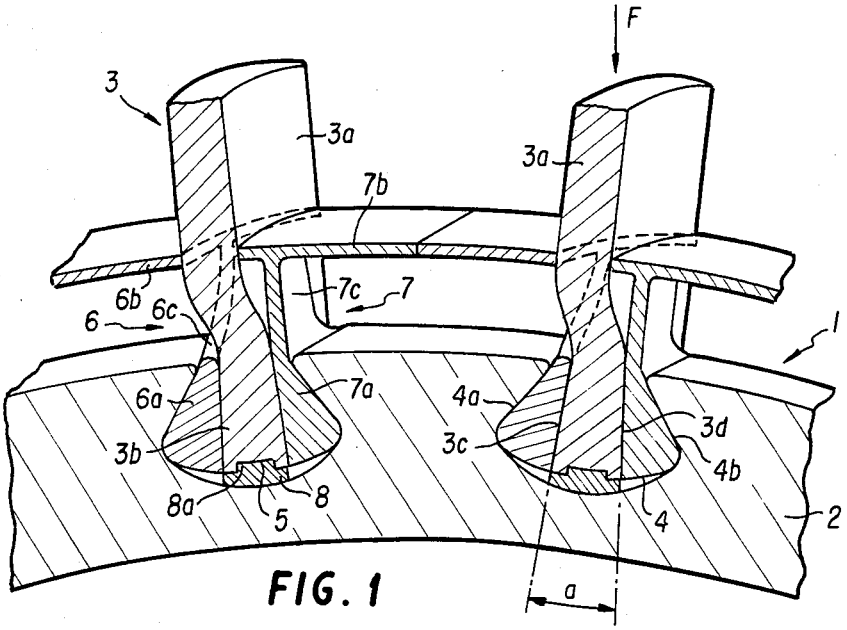
FIG. 1 is a cross-sectional view, taken perpendicular to the axis of rotation, of part of one embodiment of a turbine rotor in accordance with the invention, showing two of the blades of the rotor.

In FIG. 1 part of a turbine rotor 1 is shown composed of a disc 2 and blades 3 which rotate with the disc. The disc 2 has on its periphery a multiplicity of evenly distributed rectilinear sockets 4 which are oriented axially in the direction of the axis of rotation of the turbine rotor and which have a dovetail shaped section.

Each blade 3 has an aerofoil body portion 3*a* of which the curved profile is adapted to the aerodynamic functions it has to fulfill during operation, and a blade root 3*b* at the radially inner end of the blade 3 extending from the aerofoil body 3*a* without any break of shape occurring in the transition from the body 3*a* to the root 3*b*, which is thus perfectly continuous. The root 3*b* of the blade 3 is formed as a bulb of which the side flanks 3*c* and 3*d* are planar and define an angle of convergence a (in a radially outward direction) which may be, for example, five degrees, but must not exceed ten degrees. The bottom face of the blade root 3*b* has a notch 5 cut centrally along it in the axial direction.

The blades 3 are located with their roots 3*b* in the sockets 4 of the disc 2, and between the side flanks 3*c* and 3*d* of each blade root 3*b* and the faces 4*a* and 4*b* of the corresponding socket 4 wedge-shaped members 6*a* and 7*a* are respectively arranged on opposite sides of the blade 3. At a short distance from the periphery of the disc 2 platforms 6*b* and 7*b* are also respectively arranged on the opposite convexly and concavely curved sides of each blade 3, and these platforms 6*b* and 7*b* form a ring which constitutes a wall defining part of the radially inner boundary of the main streamline flow path of the gases passing through the turbine. According to the first embodiment shown in FIG. 1, the wedge-shaped member and the platform on each side of each blade 3 are connected and rigidly secured together by means of a strut to form a unitary element. That is, the wedge 6*a* and the platform 6*b* of each blade are joined together by a strut 6*c* to form an element 6, and similarly the wedge 7*a* and the platform 7*b* are joined by a strut 7*c* to form an element 7.

Figure 2:
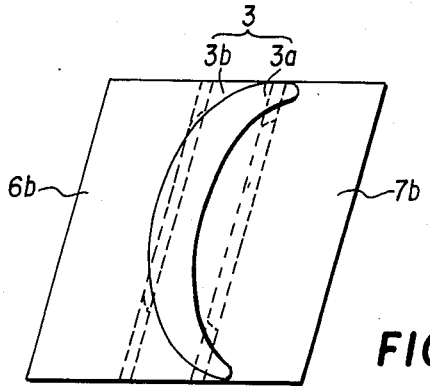
FIG. 2 is a diagrammatic top plan view of one of the blades of the turbine rotor shown in FIG. 1, looking in the direction of arrow F.

FIG. 2 is a top view showing the outline of an example of a blade 3, which has a gradual evolution of profile between the blade root 3*b* and the blade body 3*a*. Consequently, any interference must be prevented between the struts 6*c* and 7*c* and the profile of the blade. The strut 7*c* on the concavely curved side of the blade 3 thus has a recess 7*d* adjacent the leading edge of the blade and a recess 7*e* adjacent the trailing edge of the blade. Similarly, the strut 6*c* on the convexly curved side of the blade 3 has a recess 6*d* under the platform 6*b* in the middle of the strut.

A wedge 8 is inserted between the bottom face of the root of each blade and the bottom of the corresponding socket 4 of the disc 2. In co-operation with the wedges 6*a* and 7*a*, the wedge 8 serves to lock the blade root 3*b* in the radial direction. The wedge 8 has on its upper face a catch 8*a* which is disposed in the axial direction and which co-operates with the notch 5 in the bottom face of the blade root 3*b*. The catch 8*a* has at each end an edge (not shown) folded back onto the face of the disc 2 to ensure axial locking.

Figure 3B:
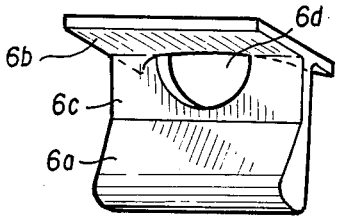
FIGS. 3*a* and 3*b* are diagrammatic perspective views of the two wedge, strut and platform elements associated with each blade of the turbine rotor shown in FIG. 1; and, FIG. 4 is a view similar to that of FIG. 1, but showing a second embodiment of a turbine rotor in accordance with the invention.
Figure 3A:
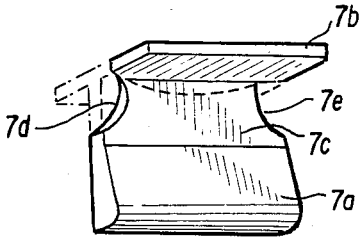
Figure 4:
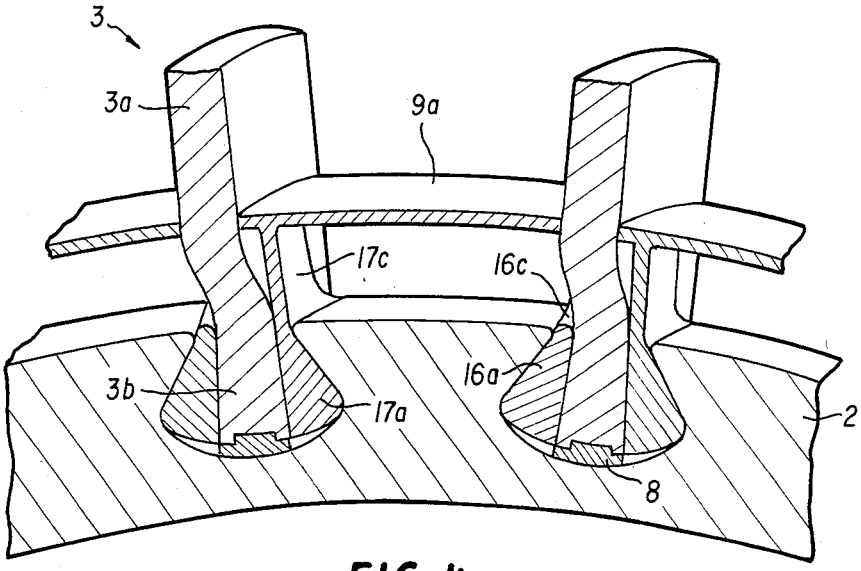

A second embodiment is shown in FIG. 4, in which the references for members which are identical with those of the first embodiment are the same as those which were used above with reference to FIGS. 1 to 3, and the references for the members which are similar have been increased by the number ten. In the second embodiment the two elements constituted each by a wedge-shaped member and a platform, and situated between two successive blades, respectively one on the concavely curved side of a blade and the other on the convexly curved side of the following blade, have their platforms joined to form a unitary part. There are thus found in FIG. 4, the disc 2 and its sockets 4, the blades 3 and their roots 3*b* and aerofoil portions 3*a*, and the locking wedges 8, and between the two blades 3 there is an intermediate part formed of a first wedge 17*a*, a first strut 17*c*, a single plate 9*a* forming a platform between the blades, a second strut 16*c*, and a second wedge 16*a*.

As indicated previously, in the various embodiments of the invention which have just been described, the blades 3 are made of a composite ceramic material which may be of a known type with oriented fibres and made in accordance with known techniques, or they may be made of ceramic material with a structure of the type termed "three-dimensional" and shaping, in this case, by machining. The platforms, separate from the blades, may also be made from a composite ceramic material or from a metallic material of heat-resistant superalloy type. In the embodiments described, micro-sliding movements between parts are observed in operation, resulting in damping of vibrations affecting the blades.

What is claimed is:

1. A turbine rotor comprising a disc, a plurality of rectilinear, axially oriented sockets in the periphery of said disc, said sockets being evenly distributed around said periphery and each having side walls and a bottom wall providing said socket with a dovetail shaped cross-section, a plurality of blades disposed in respective ones of said sockets and projecting radially outwards from said periphery of said disc, said blades being formed of a composite ceramic fibre material and each of said blades having an aerofoil shaped body radially outwards of said disc defining concavely and convexly curved sides of said blade, and a root received in one of said sockets, said root being in the form of a bulb and having a bottom face and two flat side faces defining an angle of convergence towards said body not exceeding 10 o whereby said ceramic fibres of said blade proceed continuously from said body to said root of said blade without geometric distortion, and locking means associated with each of said blades for locking said blade in said corresponding socket, said locking means including a pair of elements disposed on opposite sides of said blade, each of said elements comprising a wedge-shaped member disposed in said socket between one of said side faces of said root and the adjacent one of said side walls of said socket to ensure radial locking of said blade, a platform disposed adjacent said blade radially outwards of said disc and extending in a circumferential direction, and a strut connecting said platform to said wedge-shaped member, said platforms of said elements of said locking means of all of said blades co-operating to form a continuous ring intersected by said blades and defining part of the inner boundary of the main streamline flow path of the turbine gases.

2. A turbine rotor according to claim 1, wherein said struts of said elements on opposite sides of each blade have recesses.

3. A turbine rotor according to claim 2, wherein said strut of said element situated on said concavely curved side of said blade has recesses in the edges of said strut situated adjacent the leading and trailing edges of said blade, and said strut of said element situated on said convexly curved side of said blade has a recess at the centre of said strut under said platform of said element.

4. A turbine rotor according to claim 1, wherein said platforms of the two elements situated between each pair of successive blades are joined together whereby said two elements are joined to thus form a unitary bridge-shaped part extending between said pair of blades and having a wedge-shaped member and strut at each end, and a continuous platform between said struts.

5. A turbine rotor according to claim 1, wherein said bottom face of said root of each said blade is provided with a notch, and said locking means associated with each said blade includes a wedge inserted axially between said bottom face of said blade root and said bottom wall of said socket, said wedge having a catch co-operating with said notch, and said catch having an edge at each end thereof folded back over a face of said disc.

* * * * *

UNITED STATES PATENT AND TRADEMARK OFFICE

CERTIFICATE OF CORRECTION

PATENT NO. : 4,802,824

DATED : FEBRUARY 7, 1989

INVENTOR(S) : PHILIPPE M.D. GASTEBOIS and JEAN-FRANCOIS R. IMBAULT

It is certified that error appears in the above-identified patent and that said Letters Patent is hereby corrected as shown below:

In column 1, line 27, change "tibre" to --fibre--;

In column 3, line 65, after "root" insert --3b--;

In column 4, line 59, change "10 o" to --10°--.

Signed and Sealed this

Third Day of October, 1989

*Attest:*

DONALD J. QUIGG

*Attesting Officer*

*Commissioner of Patents and Trademarks*